US009243414B2

(12) United States Patent
Dewing

(10) Patent No.: US 9,243,414 B2
(45) Date of Patent: Jan. 26, 2016

(54) SWIMMING POOL CLEANING DEVICE

(76) Inventor: David Dewing, Thousand Oaks, CA (US)

( * ) Notice: Subject to any disclaimer, the term of this patent is extended or adjusted under 35 U.S.C. 154(b) by 761 days.

(21) Appl. No.: 12/455,163

(22) Filed: May 29, 2009

(65) Prior Publication Data

US 2010/0299863 A1 Dec. 2, 2010

(51) Int. Cl.
*E04H 4/16* (2006.01)

(52) U.S. Cl.
CPC ..... *E04H 4/1609* (2013.01)

(58) Field of Classification Search
USPC ..... 15/1.7, 347; 210/167.16
See application file for complete search history.

(56) References Cited

U.S. PATENT DOCUMENTS 3,950,809 A * 4/1976 Schatzmann ..... E04H 4/1654 15/1.7
3,984,129 A * 10/1976 Hege ..... 280/251
4,402,101 A * 9/1983 van Zyl ..... 15/1.7
5,239,721 A * 8/1993 Zahuranec ..... 15/41.1
2001/0050093 A1* 12/2001 Porat ..... 134/8
2002/0129839 A1* 9/2002 Erlich et al. ..... 134/22.18
2006/0174430 A1* 8/2006 Pareti ..... 15/1.7
2008/0244842 A1* 10/2008 Lavabre et al. ..... 15/1.7

* cited by examiner

*Primary Examiner* — Monica Carter
*Assistant Examiner* — Stephanie Berry
(74) *Attorney, Agent, or Firm* — D. Morgan Tench

(57) ABSTRACT

The swimming pool cleaner of the invention is a suction device comprising a rectangular housing, at least four wheels enabling the device to be manually rolled along the swimming pool bottom with the long sides perpendicular to the direction of motion, and two cylindrical rotary brushes adjacent and parallel to opposing long sides of the housing and driven by rotation of the device wheels. Tree leaves and other debris are effectively captured due to a downward sweeping action produced by rotation of the cylindrical rotary brush on the leading edge as the cleaning device, connected to a suction means, is rolled back and forth over the swimming pool bottom by an operator pulling and pushing on a pole attached to the top of the housing. The performance of the device is enhanced via fenders that wrap around the tops of the rotary brushes, and inclusion of various housing bottom features.

13 Claims, 7 Drawing Sheets

SWIMMING POOL CLEANING DEVICE

BACKGROUND OF THE INVENTION

1. Field of the Invention

This invention is concerned with swimming pools, and in particular with means of cleaning and removing debris from swimming pools.

2. Description of the Related Art

Swimming pool suction cleaning devices of the prior art typically comprise a rectangular housing having a substantially planar bottom with a centrally located suction hole connected to a suction means via a hose attached to a tubular outlet on the housing top. The cleaning device is moved along the pool bottom so that the housing bottom remains substantially parallel and in close proximity with the bottom of the swimming pool while water from the swimming pool is sucked through a small bottom gap between the housing bottom and the swimming pool bottom. In some cases, wheels or housing bottom protrusions are used to provide a bottom gap that is more uniform and/or optimum in width. The housing may also be made of a flexible material so that the housing bottom tends to conform to curved areas of the pool bottom. Such devices are reasonably effective for removing dirt from the pool bottom but cannot capture debris larger than the bottom gap of the device. And the bottom gap is typically very small so as to provide the fast water flow rate needed to efficiently remove dirt from the swimming pool bottom.

Various modifications designed to improve the effectiveness of pool cleaning devices have been described in the prior art. For example, U.S. Pat. No. 5,048,149 to Heinen (issued 17 Sep. 1991) describes a pool cleaning device having a fixed brush attached along the leading edge of the housing so as dislodge dirt particles by sweeping the pool surface. Such brushes tend to push debris along the pool bottom rather than direct it to the suction hole.

Some pool cleaning suction devices of the prior art provide the needed narrow bottom gap via a lip around the perimeter of a housing bottom that circumscribes a bottom suction cavity containing a means for improving the effectiveness of the device. For example, U.S. Pat. No. 5,842,243 to Horvath et al. (issued 1 Dec. 1998) describes a pool cleaning suction device having a fixed brush pivotally mounted inside a bottom suction cavity such that the brush angle changes depending on the direction of movement of the device. U.S. Pat. No. 4,402,101 to van Zyl (issued 6 Sep. 1983) describes a pool cleaner device comprising an elongated brush rotated by an electric motor and located inside the bottom suction cavity so that dirt dislodged by the sweeping action of the rotating brush is effectively captured by the device. U.S. Pat. No. 6,942,790 to Dolton (issued 13 Sep. 2005) describes a pool cleaning suction device having two cylindrical scrubbing brushes mounted inside the bottom suction cavity that are rotated in opposing directions by a mechanical drive motor.

Such prior art devices are ineffective for removing bits of debris that are too large to pass through the narrow bottom gap between the housing bottom perimeter and the pool surface. Tree leaves are particularly difficult to capture using the devices of the prior art since the leaves are often highly non-planar so that they do not readily pass through the small bottom gap needed to vacuum dirt from pool surfaces. U.S. Pat. No. 5,664,275 to Sebor (issued 5 Sep. 1997) describes a pool cleaning suction device having an oscillator that periodically widens the bottom gap around the perimeter of a bottom suction cavity so as to periodically capture larger bits of debris. The Sebor '275 device is relatively complicated and does not provide continuous capture of debris.

U.S. Pat. No. 5,001,800 to Parenti et al. (issued 26 Mar. 1991) describes a pool cleaning suction device comprising a hydraulic turbine motor that drives two pairs of wheels having rubber band treads to provide locomotion, and drives a cam that raises one of the pairs of treaded wheels off the pool bottom to provide steering. Parenti '800 further describes use of the motor to drive rotation of a cylindrical brush located along the front of the housing but does not indicate that it provides improved effectiveness for capturing large bits of debris. The Parenti '800 device is relatively complicated and is not well suited for use in small residential swimming pools.

U.S. Patent Application Publication 2006/0174430 to Pareti (published 10 Aug. 2006) describes a swimming pool cleaning device that includes an ultrasonic wave generator in a housing bottom cavity designed to dislodge adherent materials from the submerged pool surfaces. The Pareti '430 device further comprises an electric motor that drives rubber treads via drive wheels to move the device along the pool surface, and three rotary brushes. The larger brush is located within the housing bottom cavity and the two smaller brushes are located outside the housing on the leading and trailing edges. The Pareti '430 device is designed to remove recalcitrant deposits, such as limestone scale, rust, sludge and weeds, via a combination of ultrasound and scrubbing. This device is relatively complicated and is not well suited for use in small residential swimming pools. The Pareti '430 publication provides no indication that the device provides improved effectiveness for capturing large bits of debris.

As evident from the examples above, prior art efforts to improve pool cleaning devices have focused on removal of dirt and scale deposits rather than debris. Consequently, rotary brushes incorporated in prior art devices have typically been located within the suction cavity where they are ineffective as aids for capturing debris too large to directly pass through the bottom gap of the device. Prior art pool cleaning devices also tend to be powered by an electric or hydraulic motor and often include steering mechanisms, making them too bulky, complicated and expensive for use in small residential swimming pools. There is a need for a relatively simple pool cleaning device that effectively removes both dirt and debris, especially tree leaves, from swimming pool bottoms.

SUMMARY OF THE INVENTION

The present invention provides a manually operated pool cleaning device that is useful for removing both dirt and debris from a swimming pool bottom. The pool cleaning device comprises a rectangular housing connected to a suction means via a hose; at least four transport wheels rotatably attached to the rectangular housing via transport wheel axles so as to enable the pool cleaning device to be rolled along the swimming pool bottom with the long housing sides perpendicular to the direction of motion; two cylindrical rotary brushes each rotatably attached via a brush axle to the housing along one of the opposing long housing sides such that the bristles of the cylindrical rotary brush contact the swimming pool bottom; and at least two rotary drive mechanisms whereby rotation of the transport wheels, produced by rolling the pool cleaning device along the swimming pool bottom, drives rotation of the cylindrical rotary brush on the leading edge of the pool cleaning device in the same rotational direction as the transport wheels. The rotary brush on the leading edge of the pool cleaning device of the present invention produces a downward sweeping action that tends to flatten tree leaves and other debris so that they can be sucked through a small bottom gap between the housing bottom planar area and the swimming pool bottom.

In a preferred embodiment, the housing includes two curved fenders, each attached to the rectangular housing along one of the housing long sides so as to partially wrap around the top of one of the cylindrical rotary brushes and increase water flow through the bottom portion of the brush to enhance capture of debris. The housing bottom preferably also includes sloped edges along each of the housing long sides such that the bottom gap is increased adjacent to the cylindrical rotary brushes to minimize the possibility of debris catching on the outer edge of the housing bottom. Further improvement is preferably provided by a bottom suction cavity and/or channels designed to channel debris toward the suction hole bottom entrance, which is preferably beveled so as to avoid a sharp suction hole rim that could trap debris.

The pool cleaning device of the invention is relatively simple and manually operated so as to be well suited for cleaning both large and small swimming pools. Tree leaves and other debris are effectively captured due to a downward sweeping action produced by rotation of the cylindrical rotary brush on the leading edge as the pool cleaning device, connected to a suction means, is rolled back and forth in swaths over the swimming pool bottom by an operator pulling and pushing on a pole attached to the pole attachment fitting.

Further features and advantages of the invention will be apparent to those skilled in the art from the following detailed description, taken together with the accompanying drawings.

Figure 1:
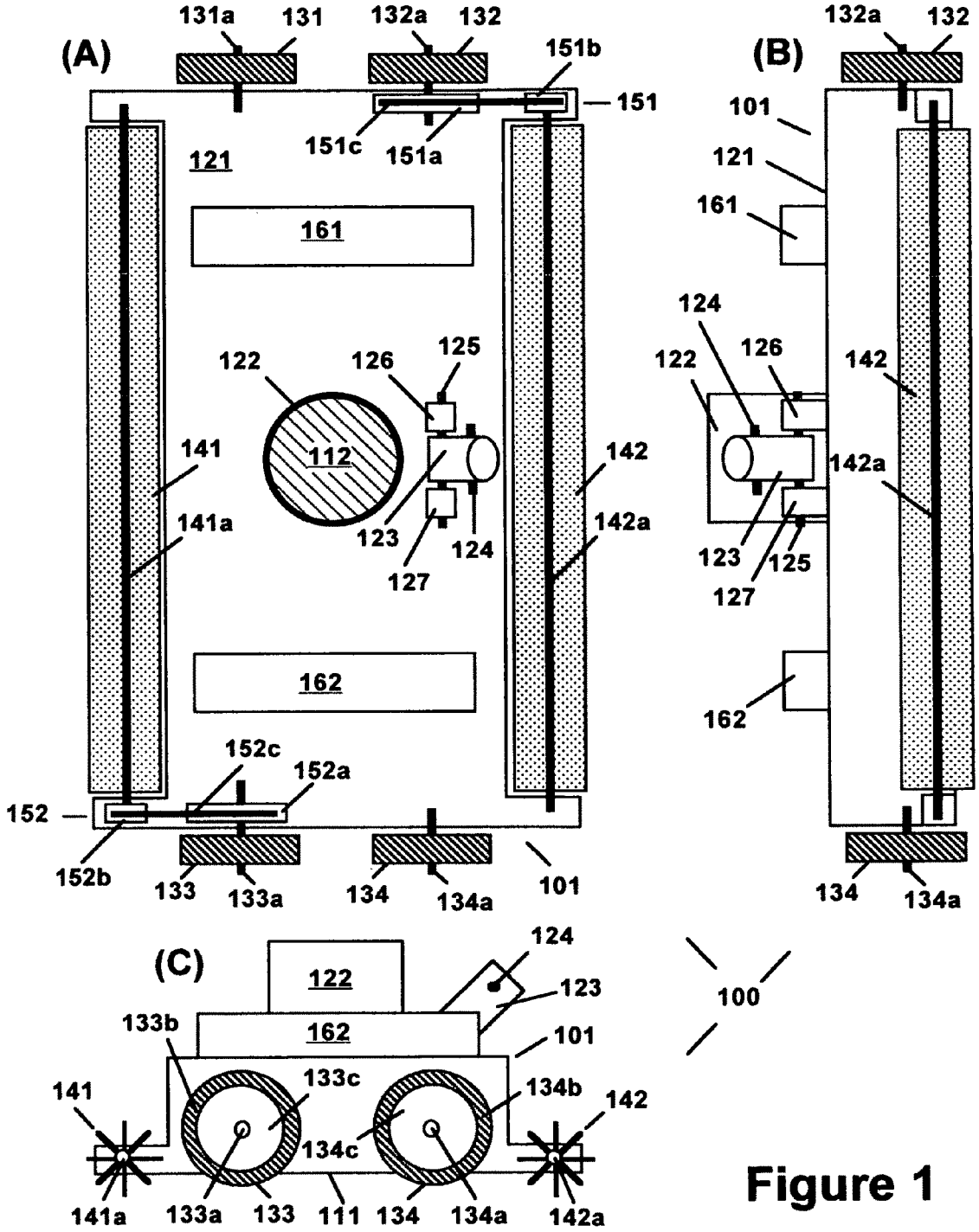
FIG. 1 schematically depicts top (A), side (B) and end (C) views of a basic embodiment of the pool cleaning device of the invention.

These figures are not to scale and some features have been enlarged for better depiction. The housing is depicted in these figures as though transparent to better illustrate details of the invention.

DETAILED DESCRIPTION OF THE INVENTION

Terminology used in this document is generally known to those skilled in the art. The term "rectangular housing" denotes the overall shape of the housing rather than a rigid mathematical geometry. The terms "rectangular housing" and "housing" are equivalent. The terms "swimming pool" and "pool" are equivalent. The terms "swimming pool bottom" and "pool bottom" are equivalent and denote all of the non-vertical submerged surfaces of a swimming pool, including curved surfaces that are usually present near the sides of a swimming pool. The term "housing bottom planar area" also applies to the same area when the housing bottom is curved so as to conform to the curvature of the swimming pool bottom. The term "debris" denotes any small object that may need to be removed from a swimming pool, tree leaves, bits of paper, and candy wrappers, for example.

The term "rotatably attached" when applied to a wheel, gear or pulley having an axle denotes that the wheel, gear or pulley may rotate about the axle or that the axle may rotate, or both. Axles employed in the pool cleaning device of the invention may be rotatably attached to housings, wheels, gears and pulleys in blind or through-holes via any suitable means, including those selected from the group consisting of slip fit, bushing, ball bearing, roller bearing, and combinations thereof. Wheels, gears and pulleys may be retained on axles by any suitable means, including those selected from the group consisting of split ring, cotter pin, retaining nut, and combinations thereof. The term "fastened" denotes that a wheel, gear or pulley is firmly attached so as to rotate with rather than around an axle. Wheels, gears and pulleys may be fastened to axles via any suitable means, including those selected from the group consisting of press fit, spline, cog, ratchet connection, and combinations thereof. Such attachment, retaining and fastening devices are well known in the art and are not depicted in the figures.

The present invention provides a pool cleaning device for removing dirt and debris from a swimming pool bottom. The pool cleaning device of the invention, comprises: (1) a rectangular housing having two short and two long housing sides and a long housing centerline, a housing bottom with a suction hole centrally located within a housing bottom planar area, and a housing top with a pole attachment fitting and a tubular outlet for connecting the suction hole to a suction means via a hose; (2) at least four transport wheels rotatably attached to said rectangular housing via transport wheel axles so as to enable the pool cleaning device to be rolled along the swimming pool bottom with the long housing sides perpendicular to the direction of motion and the width of the bottom gap between the housing bottom planar area and the swimming pool bottom remaining substantially uniform and constant at a predetermined value; (3) two cylindrical rotary brushes each having a brush axle rotatably attached at both ends to said rectangular housing so as to be parallel with the transport wheel axles and adjacent to one of the opposing long housing sides such that the bristles of said cylindrical rotary brushes contact the swimming pool bottom; and (4) at least two rotary drive mechanisms whereby rotation of said transport wheels as the pool cleaning device is rolled along the swimming pool bottom causes at least one of said cylindrical rotary brushes to rotate about its brush axle in the same rotational direction as said transport wheels.

FIG. 1 schematically depicts top (A), side (B) and end (C) views of a basic embodiment of a pool cleaning device 100 according to the invention, comprising a rectangular housing 101, four transport wheels 131, 132, 133 and 134, two cylindrical rotary brushes 141 and 142, two rotary drive mechanisms 151 and 152 whereby rotation of transport wheels 132 and 133 drives rotation of cylindrical rotary brushes 142 and 141, respectively. In FIG. 1 and subsequent figures, the rectangular housing is rendered as though transparent in order to better depict the rotary drive mechanisms, wheel axles, cylindrical brushes and brush axles. Rectangular housing 101 has a housing bottom 111 with a bottom planar area and a centrally located suction hole 112, and a housing top 121 with a pole attachment fitting 123 and a tubular outlet 122 for connecting suction hole 112 to a suction means via a hose. Transport wheels 131, 132, 133 and 134 are attached in pairs to the opposing short sides of rectangular housing 101 via transport wheel axles 131*a*, 132*a*, 133*a* and 134*a*, respectively, so as to enable pool cleaning device 100 to be rolled along the swimming pool bottom with the long housing sides perpendicular to the direction of motion and the width of the bottom gap between the bottom planar area of housing bottom 111 and the swimming pool bottom remaining substantially uniform and constant at a predetermined value. Cylindrical rotary brushes 141 and 142 have respective brush axles 141*a* and 142*a* that are rotatably attached at both ends to rectangular housing 101 so as to be parallel with wheel axles 131*a*, 132*a*, 133*a* and 134*a* and adjacent to the opposite long housing sides such that the bristles of said cylindrical rotary brushes contact the swimming pool bottom.

As indicated in FIG. 1(C) for transport wheels 133 and 134, each of the transport wheels of the pool cleaning device preferably comprises a hub (133*c* and 134*c* in FIG. 1) and a tire (133*b* and 134*b* in FIG. 1). The transport wheel tires preferably comprise a rubber-like material that provides good traction and is non-marking (does not leave marks on the swimming pool bottom). Any suitable rubber-like material may be used.

In the basic embodiment of FIG. 1, rotary drive mechanisms 151 and 152 comprise, respectively, transport wheels 132 and 133 and transport wheel pulleys 151*a* and 152*a* fastened to transport wheel axles 132*a* and 133*a*, brush pulleys 151*b* and 152*b* fastened to brush axles 142*a* and 141*a*, and drive belts 151*c* and 152*c*, whereby rotation of transport wheels 132 and 133, produced by rolling pool cleaning device 100 along the swimming pool bottom, drives rotation of the cylindrical rotary brushes 141 and/or 142 in the same rotational direction as the transport wheels. Any suitable type of rotary drive mechanism may be used, including direct drive, belt drive, gear drive, and combinations thereof. A belt or gear drive such that the rotary brushes rotate at a faster rate than the transport wheels, preferably at least 50% faster, is preferred.

The rotary drive mechanisms of the invention preferably include a ratchet gear or ratchet pulley device such that rotation of the transport wheels causes the cylindrical brush on the leading edge of the pool cleaning device to rotate but does not cause the cylindrical brush on the trailing edge of the pool cleaning device to rotate. In this case, the force required to move the pool cleaning device manually along the pool bottom is reduced without affecting the performance of the pool cleaning device. Suitable ratchet gear and ratchet pulley devices are well-known in the art.

In the basic embodiment of FIG. 1, pole attachment fitting 123 has a depressible pin 124 for connecting to a pole, and is connected to housing top 121 via a swivel pin 125 attached to housing top 121 via attachment blocks 126 and 127. Any of the various pole attachment fittings commercially available may be used with the pool cleaning device of the invention. A pole attachment fitting providing a steering capability to facilitate pushing the pool cleaning device back and forth in swaths covering the pool bottom is preferred. Tubular outlet fitting 122 typically press fits to the suction hose but may be of any suitable type, and may include a locking mechanism. Any suitable suction means may be used with the pool cleaning device of the invention. A variety of suitable suction means are known in the art. Swimming pools are generally equipped with a skimmer and a filter pump and the suction provided by this equipment is typically suitable for use with the pool cleaning device of the invention. Typical water flow rates are in the 25 to 70 gallons per minute range.

The rectangular housing of the invention may be constructed of any suitable material that is chemically compatible with swimming pool water and provides adequate strength, durability and flexibility. The rectangular housing preferably comprises a polymer material that can be readily molded and/or machined, and has sufficient flexibility to allow the housing bottom to at least partially conform to curvature of the swimming pool bottom. A preferred method of fabrication is injection molding.

The cylindrical rotary brushes may be any suitable diameter and may comprise any suitable material or combination of materials. The brush bristles may comprise metallic wires, such as stainless steel, brass or bronze, but preferably comprise polymer strands. The brush axles, which may be solid cylinders or twisted strands, preferably comprise a metal, such as stainless steel, brass or bronze, but may comprise a polymer material, such as Nylon® or Delrin®. A suitable brush diameter is 3.2 cm (1.25 inches).

With reference to FIG. 1, the planar area of housing bottom 111 circumscribes suction hole 112 and defines a bottom gap between the housing bottom planar area and the swimming pool bottom. The bottom gap should be sufficiently uniform and narrow in width to provide the uniformly high water flow rate needed to effectively remove dirt from the pool bottom and pull dirt and debris to the suction hole. The optimum bottom gap depends on the size and specific shape of housing 101 and housing bottom 111, and on the suction means employed. A bottom gap of approximately 3 mm is typically suitable. The bottom of suction hole 112 is preferably beveled so as to reduce the probability of debris being trapped at the bottom rim of suction hole 112.

The basic embodiment of FIG. 1 further comprises weights 161 and 162 attached to housing 101. The amount of added weight should be sufficient to press the transport wheels against the swimming pool bottom with sufficient force to produce adequately fast rotation of the cylindrical rotary brushes. The amount of weight needed depends on the suction force provided by the suction means employed. Weights 161 and 162 may be attached to housing 101 using fasteners, such as screws, or may be integrated into housing 101, via injection molding, for example. Weights 161 and 162 preferably comprise a relatively dense metal. The added weight may comprise any number of weights distributed in any suitable manner.

Figure 2:
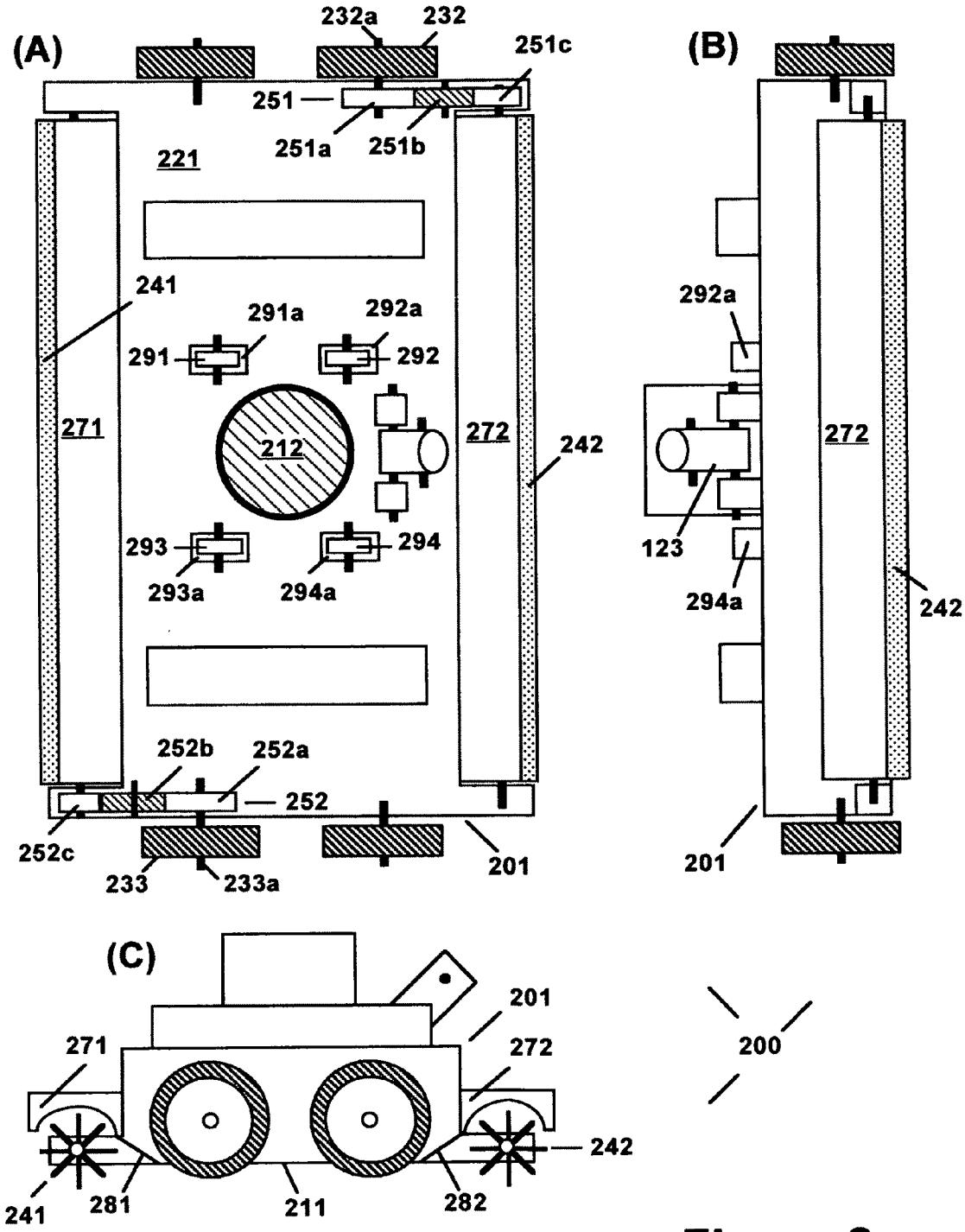
FIG. 2 schematically depicts top (A), side (B) and end (C) views of a preferred embodiment of the pool cleaning device of the invention.

FIG. 2 schematically depicts top (A), side (B) and end (C) views of a preferred embodiment of the pool cleaning device of the invention. The basic features for FIGS. 1 and 2 are the same, and are labeled in FIG. 2 only when necessary for clarity. The preferred pool cleaning device of FIG. 2 further comprises curved fenders 271 and 272 each of which is attached to rectangular housing 201 along one of the housing long sides so as to partially wrap around the tops of cylindrical brushes 241 and 242, respectively, and increase water flow through the bottom portions of brushes 241 and 242 so as to enhance capture of debris. Curved fenders 271 and 272 may be attached using fasteners, such as screws, or may be an integral part of housing 201 formed by injection molding, for example.

For the preferred pool cleaning device of FIG. 2, housing bottom 211 is sloped along the long sides of housing 201 so as to provide housing bottom sloped edges 281 and 282 such that the bottom gap is widest adjacent to brushes 241 and 242 and tapers toward the long centerline of housing 201. Housing bottom sloped edges 281 and 282 are designed to enhance capture of debris, which would otherwise tend to hang up at the sharp bottom edges of housing 201. Housing bottom sloped edges 281 and 282 may have any suitable slope and may be planar or curved.

For the preferred pool cleaning device of FIG. 2, the rotary drive mechanisms comprise gear trains 251 and 252 comprising transport wheels 232 and 233 and drive gears 251*a* and 252*a* respectively fastened to transport wheel axles 232*a* and 233*a*, intermediate gears 251*b* and 252*b* rotatably fastened to housing 201 via intermediate gear axles, and brush gears 251*c* and 252*c* respectively fastened to the axles of brushes 242 and 241. Rotation of the transport wheels causes the drive gears to rotate in the same rotational direction, the intermediate gears to rotate in the opposite direction, and the brush gears and brushes to rotate in the same rotational direction as the transport wheels. One of the gears in each of the gear trains is preferably a ratchet gear such that only the brush on the leading edge is caused to rotate by rotation of the transport wheels. The gear trains of the pool cleaning device may comprise three coplanar gears, as depicted in FIG. 2, but may alternatively comprise any suitable number of gears of any suitable diameters arranged in any configuration providing rotation of the rotary brush on the leading edge of the pool cleaning device at a suitable rotation rate in the same rotational direction as the transport wheels. The term "gear" encompasses both gears with interlocking cogs, and smooth gears engaged via friction.

In a preferred embodiment, the pool cleaning device of the invention comprises at least two and preferably four support wheels located on the housing bottom around the periphery of the suction hole so as to maintain the width of the bottom gap around the suction hole substantially uniform and constant at the predetermined value. Such support wheels are especially useful for pool cleaning devices with housings that are relatively wide and flexible, for which sagging of the housing due to suction and gravity tends to reduce water flow and consequently the effectiveness of the pool cleaning device. Support wheels are preferably located in recesses in the bottom of the housing that may result in protrusions on the top surface of the housing. The preferred pool cleaning device of FIG. 2 comprises four support wheels 291, 292, 293 and 294 in respective recesses 291*a*, 292*a*, 293*a* and 294*a* that protrude above top surface 221 of housing 201.

Figure 3:
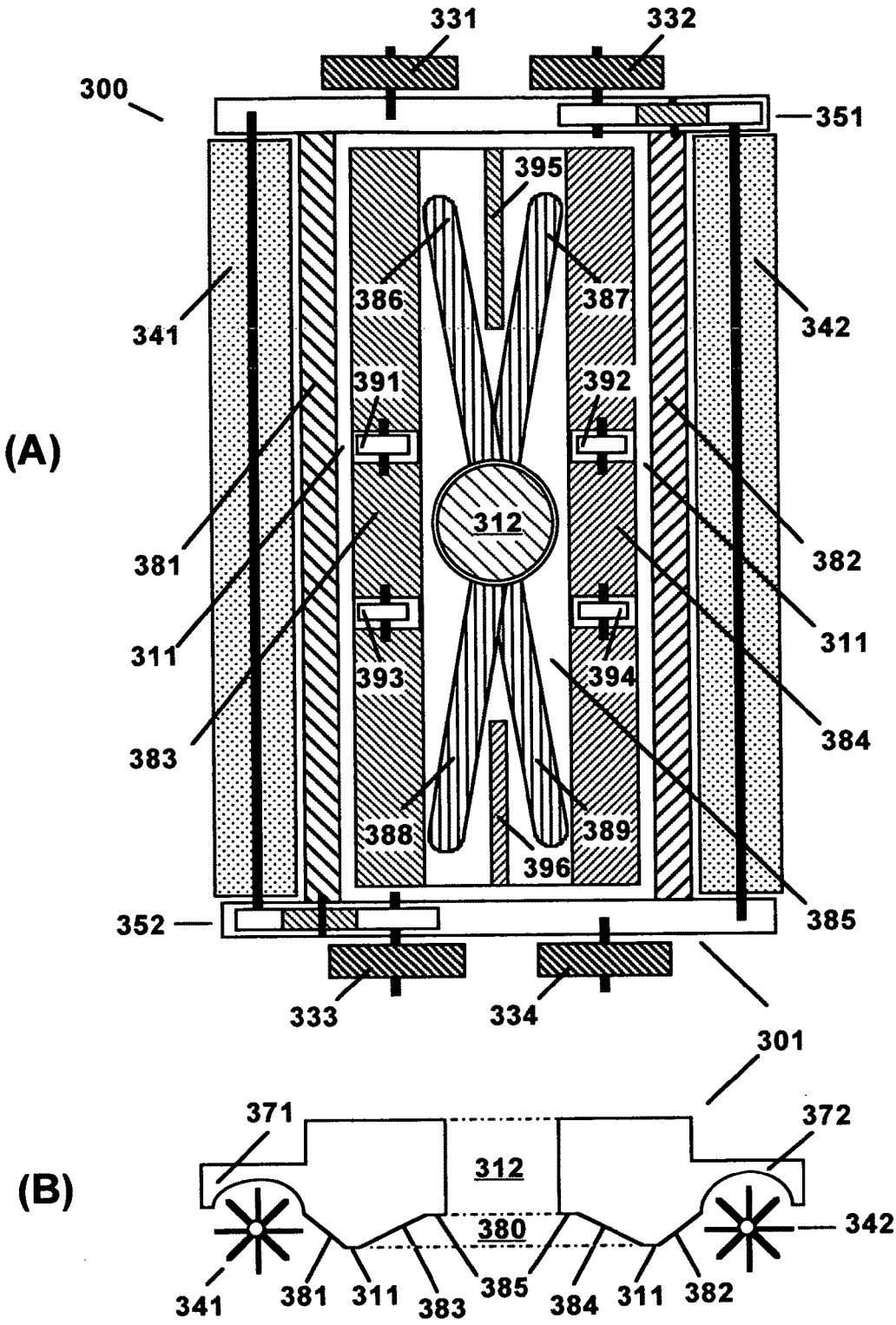
FIG. 3 schematically depicts a bottom view (A) and an end cross-sectional view (B) of a preferred embodiment of the pool cleaning device of the invention having bottom features designed to enhance capture of debris.

FIG. 3 schematically depicts a bottom view (A) and an end cross-sectional view (B) of a preferred embodiment of the pool cleaning device of the invention having bottom features designed to enhance capture of debris. Transport wheels 331, 332, 333 and 334, support wheels 391, 392, 393 and 394, rotary brushes 341 and 342, rotary drive mechanisms 351 and 352, and housing bottom sloped edges 381 and 382 are the same as described for FIG. 2. For the preferred pool cleaning device of FIG. 3, the bottom end of suction hole 312 is beveled, as indicated in FIG. 3(A), to prevent debris from being trapped at a sharp rim at the entrance to suction hole 312.

The preferred pool cleaning device of FIG. 3 also includes a bottom suction cavity 380 preferably having a trapezoidal cross-section and defined by the plane of bottom planar area 311, inclined sidewalls 383 and 384, and top cavity area 385. Bottom suction cavity 380 tends to provide a stream of water toward suction hole 312 so as to enhance capture of debris. The preferred pool cleaning device of FIG. 3 also includes four housing bottom channels 386-389, which are recessed areas in top cavity area 385 designed to channel debris toward suction hole 312. Housing bottom channels 386-389 preferably have axes that are directed toward suction hole 312, and may be oblique or parallel to the long housing sides. Housing bottom channels 386-389 may be linear (as depicted) or may be otherwise shaped, teardrop shaped, for example.

The preferred pool cleaning device of FIG. 3 further includes two housing bottom partitions 395 and 396 (protruding from housing bottom planar area 311) also designed to help conduct debris toward suction hole 312. Bottom partitions 395 and 396 preferably protrude below the housing bottom planar area by the distance of the bottom gap for the bottom planar area so that water flow is effectively directed toward the suction hole and collapse of the housing around the suction hole is prevented. In this case, support wheels may not be needed.

The curved fenders and the various bottom features designed to direct and/or enhance water flow, including housing bottom sloped edges, a beveled suction hole, a bottom suction cavity, housing bottom channels, and housing bottom partitions, may be employed individually or in any combination. Housing bottom channels, for example, may be used without a bottom suction cavity. In this case, the housing bottom channels would be recessed relative to the bottom planar and would preferably be deeper than those within a bottom suction cavity.

Figure 4:
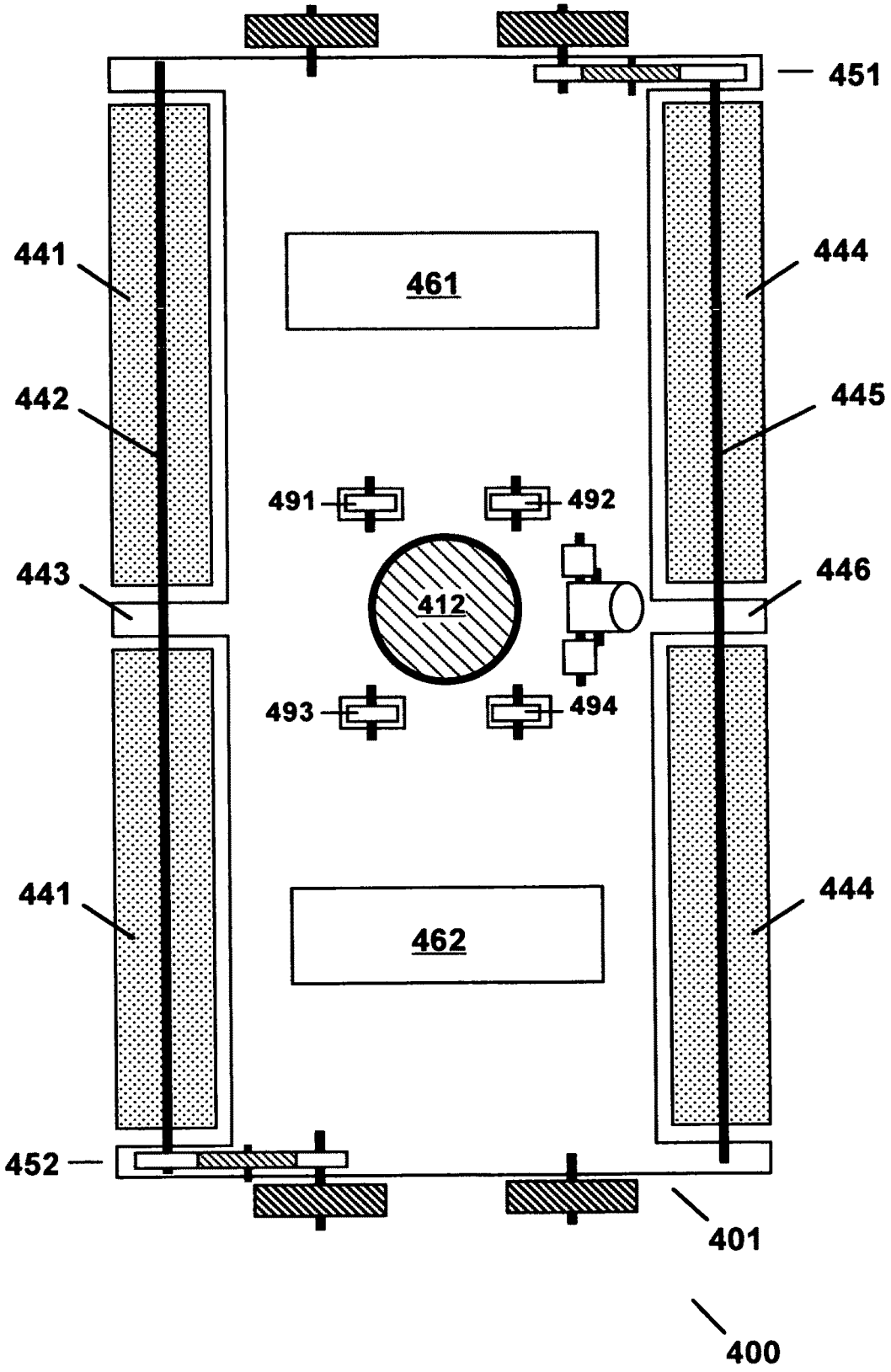
FIG. 4 schematically depicts a top view of an embodiment of the pool cleaning device of the invention having intermediate brush axle supports.

FIG. 4 schematically depicts a top view of an embodiment of the pool cleaning device of the invention having rotary brushes 441 and 444 on brush axles 442 and 445 supported by intermediate brush axle supports 443 and 446, respectively. Such axle supports may be needed for relatively wide pool cleaning devices having flexible housings and brush axles so that the housing bottom tends to conform to curvature of the swimming pool bottom. A plurality of intermediate brush axle supports may be needed. Each of the brush axles may also comprise two or more individual brush axle segments so as to increase the flexibility of the rectangular housing. In this case, each of the brush axle segments may be connected to one of the transport wheels via a separate rotary drive mechanism, or the brush axle segments for each of the rotary brushes may be interconnected via universal joints such that only two rotary drive mechanisms are needed to drive both of the cylindrical brushes.

Figure 5:
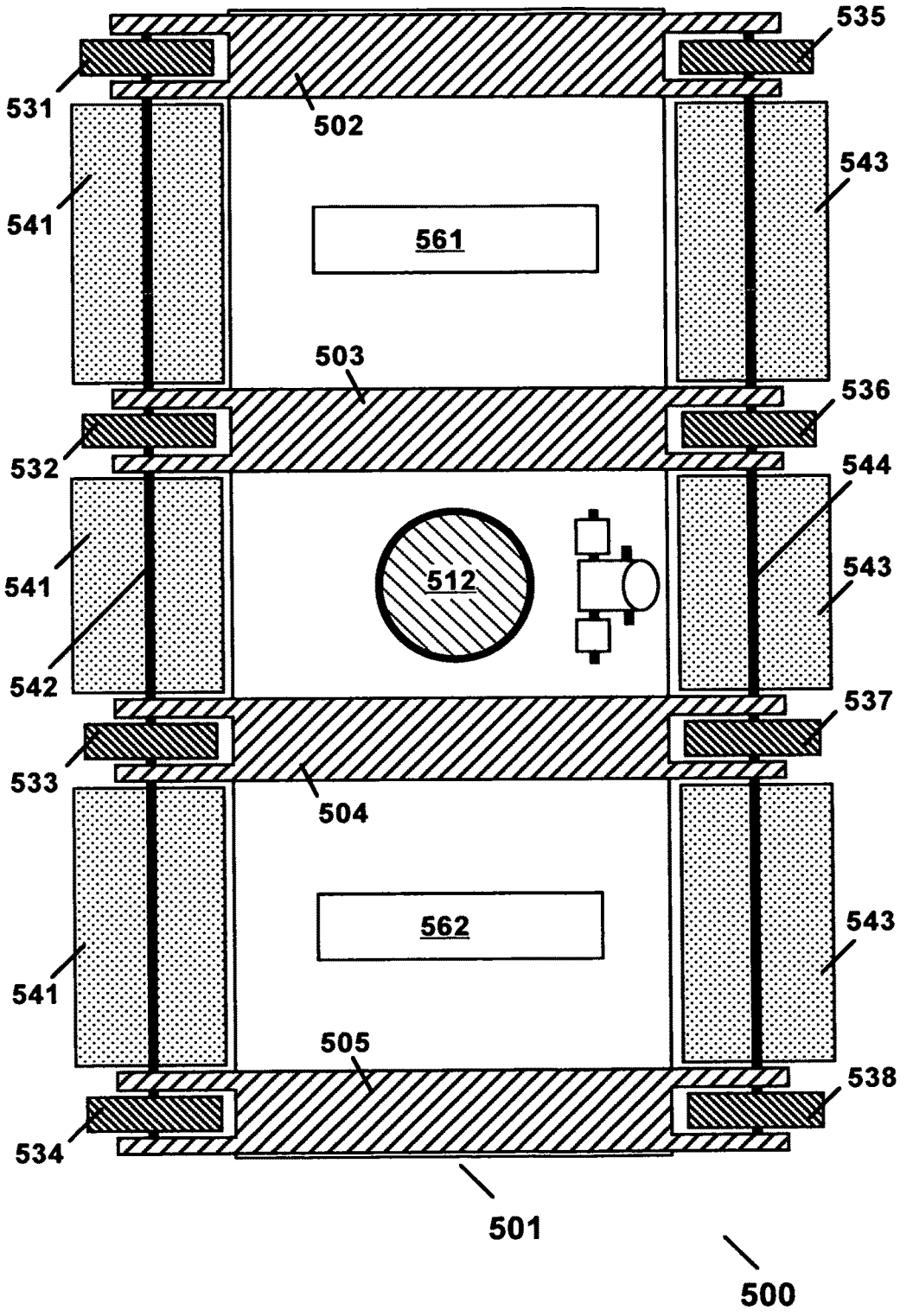
FIG. 5 schematically depicts a top view of an embodiment of the pool cleaning device of the invention for which the transport wheels and the rotary cylindrical brushes are attached to the housing via cantilevered cross-beams.

FIG. 5 schematically depicts a top view of an embodiment of the pool cleaning device of the invention for which the transport wheels and the rotary cylindrical brushes are attached to the housing via cantilevered cross-beams that overhang the long housing sides. In the embodiment depicted in FIG. 5, eight transport wheels 531-538 are connected via two axles 542 and 544 to the ends of four cantilevered cross-beams 502-505, which are perpendicular to and distributed along the long sides of rectangular housing 501. Rotary cylindrical brushes 541 and 543 are also connected via axles 542 and 544, respectively, and sections of brushes 541 and 543 are located between the cantilevered cross-beams. For the pool cleaning device depicted in FIG. 5, all of the sections of cylindrical brushes 541 and 543 are fastened to axles 542 and 544, respectively, and at least one transport wheel is fastened to each axle so as to directly drive rotation of rotary brushes 541 and 543. In an alternative embodiment (not depicted), transport wheels 531-538 are rotatably attached to axles 542 and 544, and at least one of the wheels on each axle is connected to a rotary drive mechanism such that rotation of the connected wheels causes rotary brushes 541 and 543 to rotate, preferably at a faster rate, in the same direction as the connected wheels. In either embodiment, a ratchet gear or pulley is preferably included in the rotary drive mechanisms such that only the rotary brush on the leading edge of the pool cleaning device is caused to rotate.

An advantage of the cantilevered device of FIG. 5 is that the rectangular housing itself can be very flexible in the direction parallel with the housing long sides so as to better conform to the curvature of the pool bottom. In this case, attached cantilevered cross-beams 502-505 provide the stiffness needed to maintain a uniform housing bottom gap, and transport wheels 532, 533, 536 and 537 are located near to suction hole 512 so that support wheels are not needed. Any number of cantilever beams, transport wheels, and cylindrical brush sections may be used. Cantilever beams may be separate parts attached to the housing by any suitable means, such as screws, or may be an integral part of the housing.

DESCRIPTION OF A PREFERRED EMBODIMENT

Example 1

Preliminary Tests

For preliminary tests of the invention, a commercial pool cleaning device having four cantilevered crossbeams with eight transport wheels attached to the ends thereof was modified by installing three cylindrical brushes (one-inch diameter with brass bristles) between the four transport wheels along each side of the housing, as depicted in FIG. 5. The three cylindrical brushes and the four transport wheels along each side of the housing shared a common axle so that the brushes were directly driven and rotated at the same rate and in the same direction as the transport wheels. The modified pool cleaning device was found to be more effective than the unmodified device for capturing tree leaves but the tests indicated that a faster brush rotation rate and/or a larger brush diameter might be beneficial.

As depicted in FIGS. 2 and 3, a preferred pool cleaning device according to the invention comprises a rectangular housing with a beveled suction hole and two transport wheels attached to each of its short sides, a rotary brush adjacent to each of the housing long sides and driven by rotation of a transport wheel via a gear rotary drive mechanism that includes a ratchet connection, four recessed support wheels located around the periphery of the suction hole, two curved fenders each of which is attached to the housing and partially wraps around the top of one of the cylindrical rotary brushes, and a housing bottom that includes housing bottom sloped edges along the housing long sides, a bottom suction cavity, and four housing bottom channels for channeling water flow toward the suction hole. The housing and the brush axles are preferably flexible so that the pool cleaning device tends to conform to curvature in the swimming pool bottom. For sufficiently wide devices, the flexible brush axle should be supported by intermediate brush axle supports attached to the housing.

Example 2

Prototype Pool Cleaning Device

A prototype pool cleaning device according to the invention was designed and is under construction. The rectangular housing of the prototype device is approximately 51 cm wide (long side not including the transport wheels), 19 cm long and 3.5 cm tall (not including the hose connection which extends 2.6 cm above the top of the housing). The suction hole has an inside diameter of 4.6 cm. The prototype housing will be constructed of a resin photopolymer (mechanically similar to ABS and BPT plastics) using a computer-controlled laser polymerization process. A more flexible material is preferred for production devices.

The four transport wheels of the prototype device are 2.5 cm wide and have an overall diameter of 5.0 cm (including a non-marking tire about 1.0 cm thick), and are each attached to the housing via a transport wheel axle (1.5 cm diameter) and a plastic bushing. The four recessed support wheels are 1.3 cm wide and have an overall diameter of 2.2 cm, and are positioned around the suction hole as indicated in FIG. 3.

The cylindrical rotary brushes of the prototype device have an overall diameter of 3.2 cm (1.25 inches) and comprise Nylon® bristles attached to a non-metallic brush axle 9.5 mm in diameter (fastened ends reduced to 6 mm diameter). The cylindrical rotary brushes are driven at 1.5 times the rotation rate of the transport wheels via rotary drive mechanisms comprising three Nylon® gears each and including a ratchet connection. The bottom gap between the bottom planar area and the swimming pool bottom is 2.4 mm.

The prototype housing includes integral curved fenders that wrap around the top of each cylindrical rotary brush with approximately 3 mm clearance between the curved fenders and the brush bristles. The housing bottom long edges are sloped at 17° over a distance of 1.6 cm so that the bottom gap increases to 3.2 mm adjacent to the cylindrical rotary brushes. The housing bottom includes a bottom suction cavity approximately 8 mm deep relative to the bottom planar area, and four bottom channels approximately 2.8 mm deep relative to the top of the suction cavity. The prototype housing bottom also includes two housing bottom partitions, positioned as indicated in FIG. 3. The partitions protrude relative to the bottom planar area by the bottom gap distance (2.4 mm) at the bottom planar area.

Figure 6:
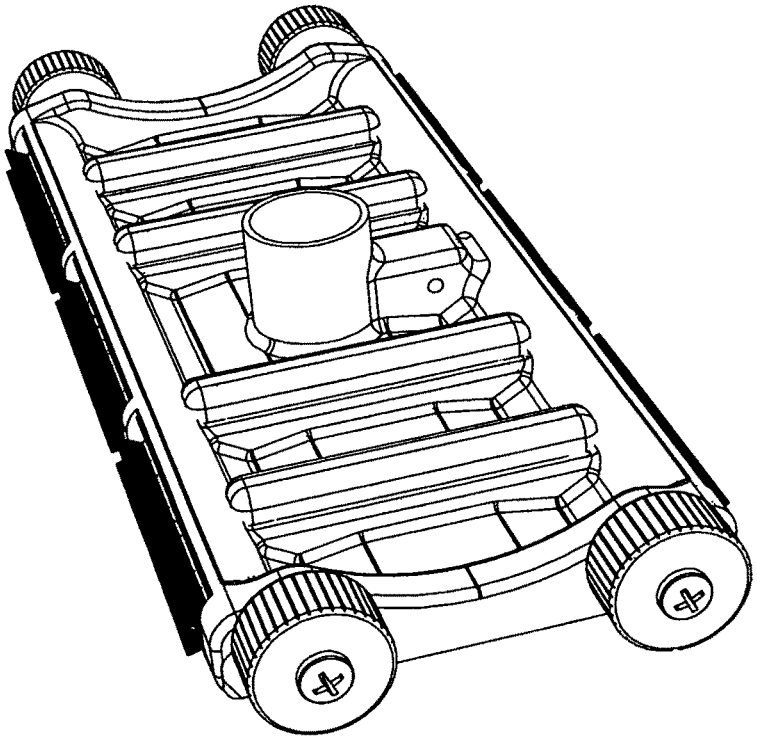
FIG. 6 is a computer-generated oblique image of the top of the prototype pool cleaning device of the invention.

FIG. 6 is a computer-generated oblique image of the top of the prototype pool cleaning device of the invention showing the housing with two transport wheels on each of the short housing sides and a cylindrical rotary brush along each of the long housing sides with two intermediate brush axle supports. In this image, the two curved fenders, the suction hole tubular outlet, pole attachment fitting, and four attached weights are evident. The amount of added weight (number of attached weights) may be adjusted based on tests of the prototype pool cleaning device.

Figure 7:
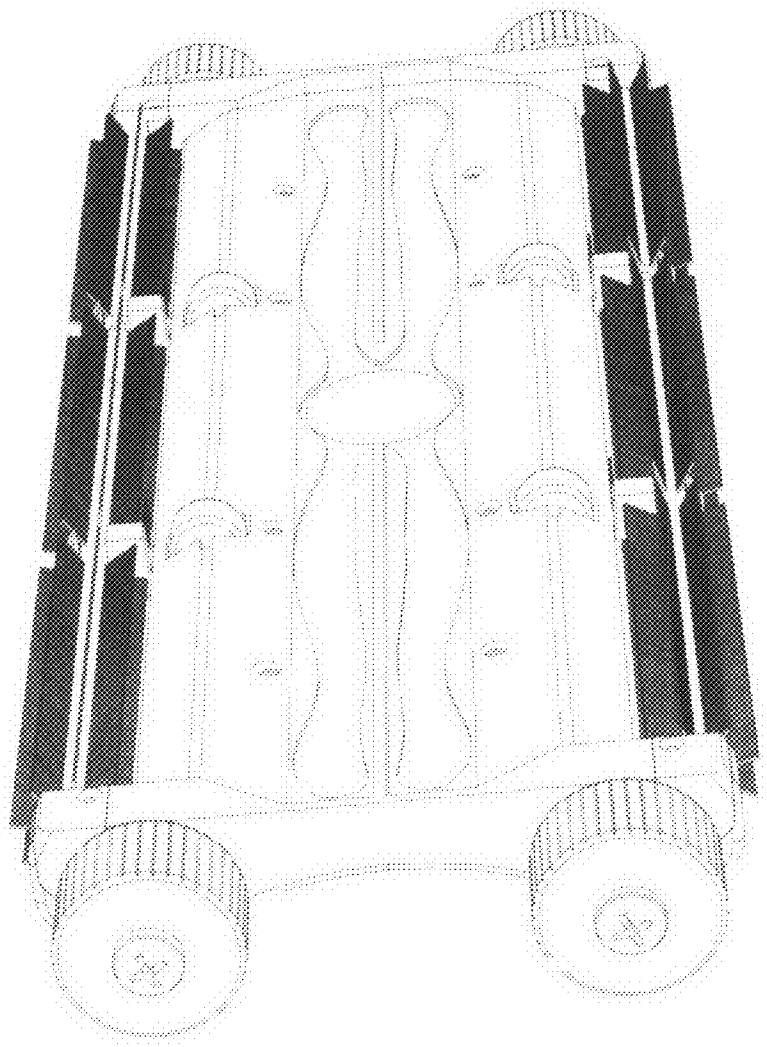
FIG. 7 is a computer-generated oblique image of the bottom of the prototype pool cleaning device of the invention.

FIG. 7 is a computer-generated oblique image of the bottom of the prototype pool cleaning device of the invention showing the housing with two transport wheels on each of the short housing sides and a cylindrical rotary brush along each of the long housing sides with two intermediate brush axle supports. In this image, the four support wheels positioned around the beveled suction hole, the bottom suction cavity, two housing bottom partitions, and four housing bottom channels are evident.

The preferred embodiments of the present invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

I claim:

1. A pool cleaning device for removing dirt and debris from a swimming pool bottom, comprising:

a rectangular housing having two short and two long housing sides and a long housing centerline, a housing bottom with a suction hole centrally located within a housing bottom planar area, and a housing top with a pole attachment fitting and a tubular outlet for connecting the suction hole to a suction means via a hose;

at least four transport wheels rotatably attached to said rectangular housing via transport wheel axles so as to enable the pool cleaning device to be rolled along the swimming pool bottom with the long housing sides perpendicular to the direction of motion and the width of the bottom gap between the housing bottom planar area and the swimming pool bottom remaining substantially uniform and constant at a predetermined value;

two cylindrical rotary brushes each having a brush axle rotatably attached at both ends to said rectangular housing so as to be parallel with the transport wheel axles and adjacent to one of the opposing long housing sides such that the bristles of said cylindrical rotary brushes contact the swimming pool bottom; and at least two rotary drive mechanisms each of which includes a ratchet connection whereby rotation of said transport wheels, produced by rolling the pool cleaning device along the swimming pool bottom, drives rotation of the cylindrical rotary brush on the leading edge of the pool cleaning device in the same rotational direction as said transport wheels but does not cause the cylindrical brush on the trailing edge of the pool cleaning device to rotate, whereby tree leaves and other debris are effectively captured due to a downward sweeping action produced by rotation of the cylindrical rotary brush on the leading edge as the pool cleaning device, connected to a suction means, is rolled back and forth over the swimming pool bottom by an operator pulling and pushing on a pole attached to the pole attachment fitting.

2. A pool cleaning device for removing dirt and debris from a swimming pool bottom, comprising:

a rectangular housing having two short and two long housing sides and a long housing centerline, a housing bottom with a suction hole centrally located within a housing bottom planar area, and a housing top with a pole attachment fitting and a tubular outlet for connecting the suction hole to a suction means via a hose;

at least four transport wheels rotatably attached to said rectangular housing via transport wheel axles parallel with the long housing sides and the housing bottom planar area so as to enable the pool cleaning device to be rolled along the swimming pool bottom with the long housing sides perpendicular to the direction of motion and the width of the bottom gap between the housing bottom planar area and the swimming pool bottom remaining substantially uniform and constant at a predetermined value;

two cylindrical rotary brushes having brush axles rotatably attached at both ends to said rectangular housing so as to be parallel with the transport wheel axles and adjacent to the opposite long housing sides such that the bristles of said cylindrical rotary brushes contact the swimming pool bottom; and at least two rotary drive mechanisms each of which includes a ratchet connection whereby rotation of said transport wheels as the pool cleaning device is rolled along the swimming pool bottom causes at least one of said cylindrical brushes to rotate about its brush axle in the same rotational direction as said transport wheels but does not cause the cylindrical brush on the trailing edge of the pool cleaning device to rotate, whereby tree leaves and other debris are effectively captured due to a downward sweeping action produced by rotation of the cylindrical rotary brush on the leading edge as the pool cleaning device, connected to a suction means, is rolled back and forth over the swimming pool bottom by an operator pulling and pushing on a pole attached to the pole attachment fitting.

3. The pool cleaning device of claim 2, wherein two of said transport wheels are attached to each of the opposite housing short sides.

4. The pool cleaning device of claim 2, wherein said rotary drive mechanisms are selected from the group consisting of direct drive, belt drive, gear drive, and combinations thereof.

5. The pool cleaning device of claim 2, further comprising:

a sufficient amount of weight, attached to said housing, to press said transport wheels against the swimming pool bottom with sufficient force to produce adequately fast rotation of said cylindrical rotary brushes.

6. The pool cleaning device of claim 2, wherein said rotary drive mechanisms are geared such that said cylindrical brushes rotate at a rotational rate that is greater than the rotational rate of said transport wheels.

7. The pool cleaning device of claim 2, wherein the brush axles and the housing are flexible so that the housing bottom tends to conform to curvature of the swimming pool bottom.

8. The pool cleaning device of claim 2, further comprising:

at least two and preferably four support wheels located on the housing bottom around the periphery of the suction hole so as to maintain the width of the bottom gap around the suction hole substantially uniform and constant at the predetermined value.

9. The pool cleaning device of claim 2, wherein each of the brush axles is supported at one or more intermediate locations between the ends of the brush axle by one or more brush axle supports fastened to said rectangular housing.

10. The pool cleaning device of claim 2, further comprising:

at least two cantilevered cross-beams perpendicular to the long sides of said rectangular housing, wherein the axles of said transport wheels and said cylindrical rotary brushes are rotatably connected to the ends of said cantilevered cross-beams.

11. The pool cleaning device of claim 2, wherein each of the brush axles comprises two or more individual brush axle segments so as to increase the flexibility of said rectangular housing so that the housing bottom can better conform to curvature of the swimming pool bottom.

12. The pool cleaning device of claim 11, wherein each of the brush axle segments is connected to one of said transport wheels via a separate rotary drive mechanism.

13. The pool cleaning device of claim 11, wherein the brush axle segments for each of said rotary brushes are interconnected via universal joints such that only two rotary drive mechanisms are needed to cause each of said cylindrical brushes to rotate.

* * * * *